US012595704B2

(12) United States Patent
Bilen et al.

(10) Patent No.: US 12,595,704 B2
(45) Date of Patent: Apr. 7, 2026

(54) CASING DRILL BIT FACILITATING DRILL-OUT THEREOF, AND RELATED METHODS OF MANUFACTURE AND USE

(71) Applicant: Baker Hughes Oilfield Operations LLC, Houston, TX (US)

(72) Inventors: Juan Miguel Bilen, The Woodlands, TX (US); Nathaniel R. Adams, The Woodlands, TX (US); Melody Alicia Maldonado, The Woodlands, TX (US); Eric Roberto Fankhauser, Houston, TX (US); Nicole Rojas, Tomball, TX (US)

( * ) Notice: Subject to any disclaimer, the term of this patent is extended or adjusted under 35 U.S.C. 154(b) by 0 days.

(21) Appl. No.: 18/672,284

(22) Filed: May 23, 2024

(65) Prior Publication Data

US 2024/0392629 A1 Nov. 28, 2024

Related U.S. Application Data

(60) Provisional application No. 63/507,366, filed on Jun. 9, 2023, provisional application No. 63/504,700, filed on May 26, 2023.

(51) Int. Cl.
*E21B 10/43* (2006.01)

(52) U.S. Cl.
CPC ..... *E21B 10/43* (2013.01)

(58) Field of Classification Search
CPC ..... E21B 10/43; E21B 7/20; E21B 10/26
See application file for complete search history.

(56) References Cited

U.S. PATENT DOCUMENTS

| | | | | |
|---|---|---|---|---|
| 3,491,844 | A | 1/1970 | Kelly, Jr. | |
| 5,816,346 | A * | 10/1998 | Beaton | E21B 10/43 175/431 |
| 10,774,595 | B2 | 9/2020 | Russell et al. | |
| 2005/0183892 | A1 * | 8/2005 | Oldham | E21B 7/20 175/402 |
| 2006/0185901 | A1 | 8/2006 | Sinor et al. | |
| 2010/0155151 | A1 * | 6/2010 | Drews | E21B 10/55 175/431 |
| 2010/0307837 | A1 * | 12/2010 | King | E21B 7/20 175/425 |

OTHER PUBLICATIONS

International Search Report for Application No. PCT/US2024/030714 dated Sep. 6, 2024, 7 pages.
International Written Opinion for Application No. PCT/US2024/030714 dated Sep. 6, 2024, 5 pages.

* cited by examiner

*Primary Examiner* — Caroline N Butcher
(74) *Attorney, Agent, or Firm* — Baker Hughes Company

(57) ABSTRACT

An earth boring system includes a drill-out bit disposed at a distal end of a drill string. The drill-out bit includes blades. The system also includes a casing drill bit that has a drill bit body with a bottom profile. The bottom profile at least partially matches a profile of the blades of the drill-out bit. The drill-out bit is operable to drill through the casing drill bit.

18 Claims, 4 Drawing Sheets

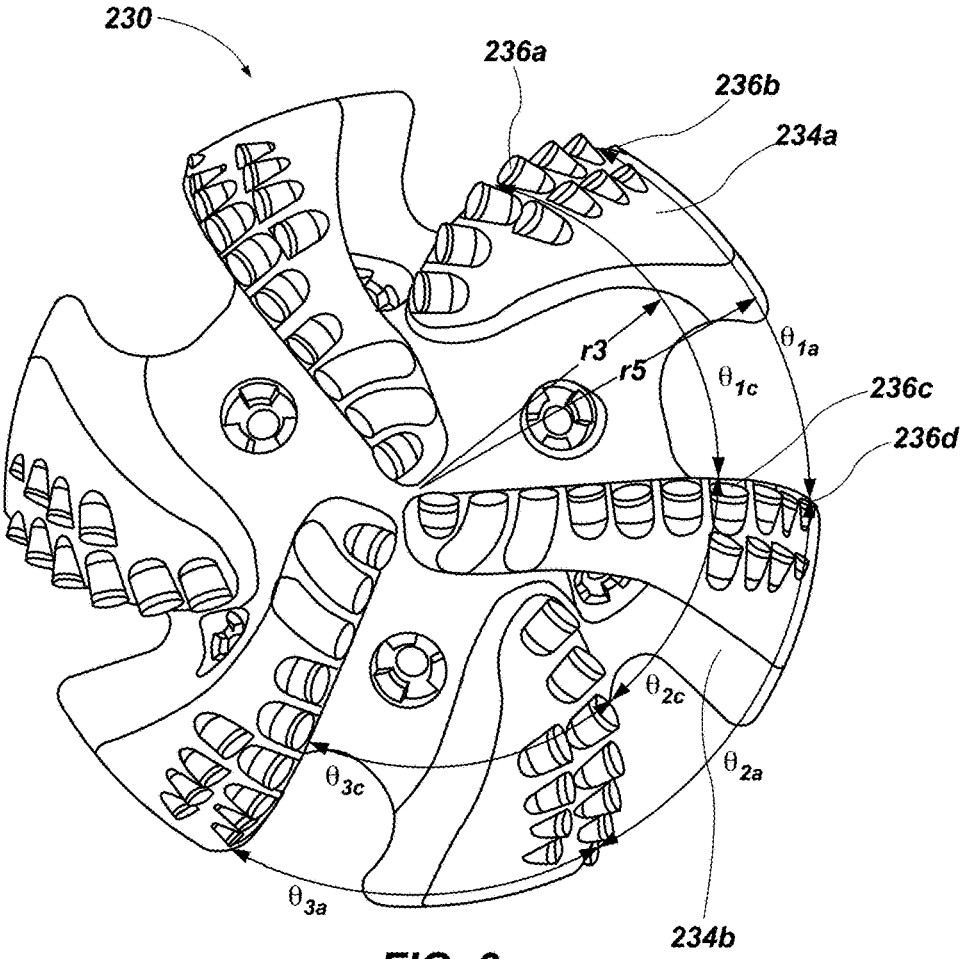

FIG. 3

$$\theta_{1a} \neq \theta_{1b} \neq \theta_{1c} \neq \theta_{1d} \neq \theta_{1e} \neq$$
$$\theta_{2a} \neq \theta_{2b} \neq \theta_{2c} \neq \theta_{2d} \neq \theta_{2e} \neq$$
$$\theta_{3a} \neq \theta_{3b} \neq \theta_{3c} \neq \theta_{3d} \neq \theta_{3e} \neq$$
$$\theta_{4a} \neq \theta_{4b} \neq \theta_{4c} \neq \theta_{4d} \neq \theta_{4e} \neq$$
$$\theta_{5a} \neq \theta_{5b} \neq \theta_{5c} \neq \theta_{5d} \neq \theta_{5e} \neq$$
$$\theta_{6a} \neq \theta_{6b} \neq \theta_{6c} \neq \theta_{6d} \neq \theta_{6e} \neq$$

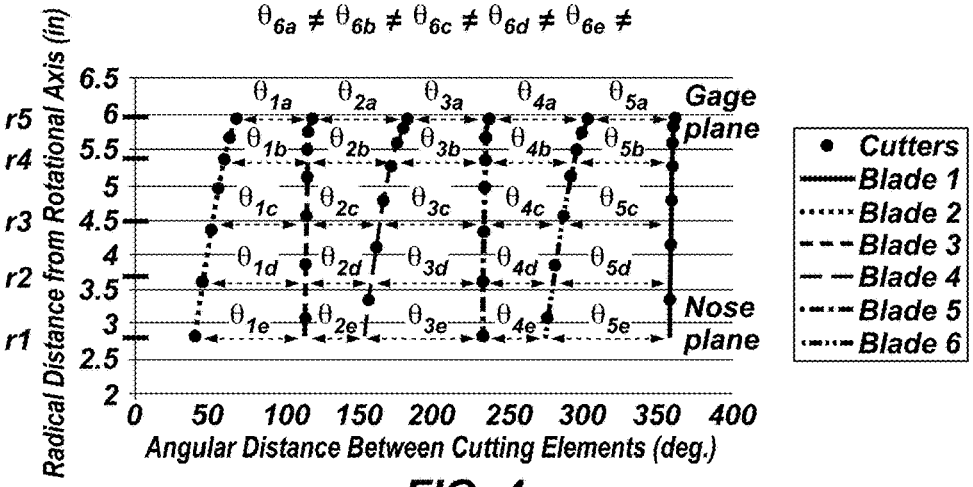

FIG. 4

CASING DRILL BIT FACILITATING DRILL-OUT THEREOF, AND RELATED METHODS OF MANUFACTURE AND USE

CROSS-REFERENCE TO RELATED APPLICATIONS

This application claims the benefit under 35 U.S.C. § 119(e) of U.S. Provisional Patent Application Ser. No. 63/504,700, filed May 26, 2023, and U.S. Provisional Patent Application Ser. No. 63/507,366, filed Jun. 9, 2023, the disclosure of each of which is hereby incorporated herein in its entirety by this reference.

TECHNICAL FIELD

Embodiments of the present disclosure generally relate to earth-boring (e.g., downhole) tools. In particular, embodiments of the present disclosure relate to earth-boring tools, apparatus, and methods used to insert casings within a wellbore in a subterranean formation.

BACKGROUND

The drilling of wells for oil and gas production conventionally employs longitudinally extending sections or so-called "strings" of drill pipe to which, at one end, is secured a drill bit of a relatively large diameter. After a selected portion of the borehole has been drilled, the borehole is usually lined or cased with a string or section of casing. Such a casing or liner usually exhibits a larger diameter than the drill pipe and a smaller diameter than the drill bit. Therefore, drilling and casing according to the conventional process typically requires sequentially drilling the borehole using drill string with a drill bit attached thereto, removing the drill string and drill bit from the borehole, and disposing casing into the borehole. Further, often after a section of the borehole is lined with casing, which is usually cemented into place, additional drilling beyond the end of the casing may be desired.

Unfortunately, sequential drilling and casing may be time consuming because, as may be appreciated, at the considerable depths reached during oil and gas production, the time required to implement complex retrieval procedures to recover the drill string before running casing may be considerable. Such operations may be costly as well, since, for example, the beginning of profitable production can be greatly delayed. Moreover, control of the well may be difficult during the time that the drill pipe is being removed and the casing is being disposed into the borehole. Thus, in some instances, it is known to combine the drilling and casing processes into one run by attaching a "casing bit" to the end of a casing string and drilling with the casing string itself instead of with a conventional drill string.

SUMMARY

According to some embodiments, an earth boring system includes a drill-out bit disposed at a distal end of a drill string. The drill-out bit includes blades. The system also includes a casing drill bit that has a drill bit body with a bottom profile. The bottom profile at least partially matches a profile of the blades of the drill-out bit. The drill-out bit is operable to drill through the casing drill bit.

According to some embodiments, a casing drill bit includes a casing drill bit body and blades extending from the casing drill bit body. Each blade includes cutting elements. First angular distances between the cutting elements on circumferentially neighboring blades of the blades are unequal to one another at a first radial distance from a rotational axis of the casing drill bit.

According to some embodiments, an earth boring system includes a drill-out bit disposed at a distal end of a drill string. The drill-out bit includes drill-out blades. The system further includes a casing drill bit. The casing drill bit includes a first casing drill bit blade and a second casing drill bit blade. A first angular distance between the first drill bit blade and the second drill bit blade at a first radius is not equal to a second angular distance between the first drill bit blade and the second drill bit blade at a second radius where the second radius is larger than the first radius. The drill-out bit is configured to drill through the casing drill bit.

BRIEF DESCRIPTION OF THE DRAWINGS

For a detailed understanding of the present disclosure, reference should be made to the following detailed description, taken in conjunction with the accompanying drawings, in which like elements have generally been designated with like numerals, and wherein:

FIG. 3 illustrates an exemplary casing drill bit with varying angular distance between cutting elements at different radial distances from a central axis;

FIG. 4 illustrates a graph showing varying angular distances between cutting elements at different radial distances from a central axis.

DETAILED DESCRIPTION

Figure 1:
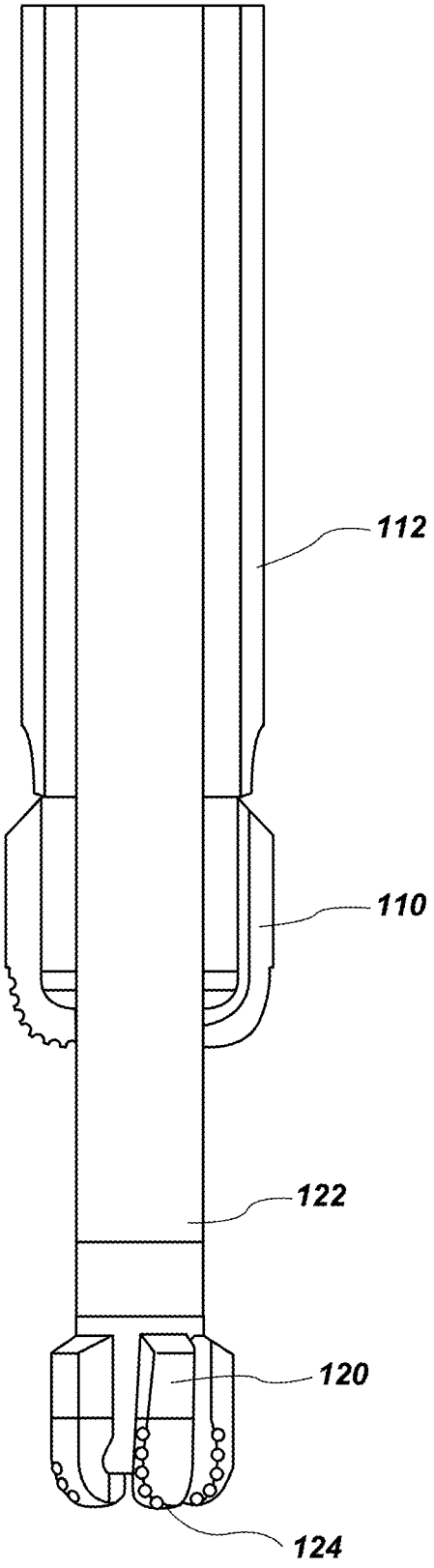
FIG. 1 illustrates an exemplary earth boring system.

The illustrations presented herein are not actual views of any drill bit, casing drill bit, earth-boring tool, or any component thereof, but are merely idealized representations, which are employed to describe embodiments of the present invention.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, any relational term, such as "first," "second," "top," "bottom," "upper," "lower," "above," "beneath," "side," "upward," "downward," etc., is used for clarity and convenience in understanding the disclosure and accompanying drawings, and does not connote or depend on any specific preference or order, except where the context clearly indicates otherwise. For example, these terms may refer to an orientation of elements of any drill bit, casing drill bit, earth-boring tool, or any component thereof when utilized in a conventional manner. Furthermore, these terms may refer to an orientation of elements of any drill bit, casing drill bit, earth-boring tool, or any component thereof as illustrated in the drawings.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

FIG. 1 shows an exemplary earth boring system comprising a casing drill bit 110 with an associated casing 112 and a drill-out bit 120 with an associated drill string 122. The casing drill bit 110 may be used to drill a borehole for the casing 112. When the casing drill bit 110 extends into the borehole to a predetermined depth, the casing 112 may be secured in place within the borehole, such as by cementing the casing 112 in the borehole. The drill-out bit 120 may then be used to drill through the casing drill bit 110 via blades 124 to further extend the depth of the borehole. It will be appreciated that any suitable drill-out bit may be utilized to drill through the casing drill bit 110 such as a rollercone drill bit, or the like.

When using the drill-out bit 120 to drill through the casing drill bit 110 to extend the borehole, the drill-out bit 120 may become damaged including but not limited to the blades 124. When the drill-out bit 120 is damaged, the effectiveness of the drill-out bit 120 decreases, and a rate of penetration ("ROP") of the drill-out bit 120 and drill string 122 decreases. In some instances, if the drill-out bit 120 becomes damaged, the drill-out bit 120 must be replaced, necessitating removal and replacement of the drill-out bit 120, which among other drawbacks, can be time consuming. Thus, when damage to the drill-out bit 120 is prevented, the ROP of drilling the borehole may be increased.

Figure 2A:
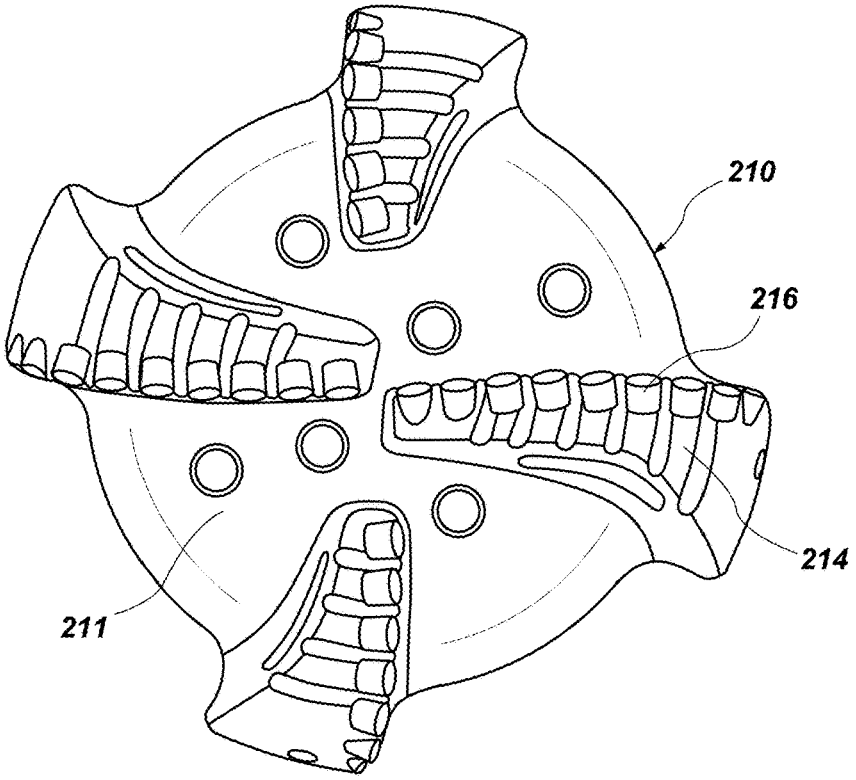
FIG. 2A illustrates a baseline example of a casing drill bit.

FIG. 2A shows a baseline example of a casing drill bit, and FIG. 2A shows an exemplary casing drill bit according to one example of the present disclosure. A baseline casing drill bit 210 may comprise a plurality of blades 214. Each of the blades 214 may comprise a plurality of cutting elements 216. When a drill-out bit, such as drill-out bit 120 discussed above, drills through the baseline casing drill bit 210, the drill-out bit may experience excessive damage. Such damage may be caused by the presence of chatter caused by interruptions in cutting during the drill-out process. For example, when the drill-out bit reaches a depth of the blades 214 of the baseline casing drill bit 210, the drill-out bit may rotate and advance contacting successive blades 214 of the baseline casing drill bit 210. As the drill-out bit jumps from blade 214 to blade 214 as it cuts through the baseline casing drill bit 210, the drill-out bit may experience resulting interruptions causing chatter, which may lead to damage in the drill-out bit.

Furthermore, as the drill-out bit advances through the baseline casing drill bit 210, the drill-out bit may encounter different portions of the baseline casing drill bit 210 at different times. These varying portions of the baseline casing drill bit 210 may comprise different types of material resulting in increased chatter and interruptions in cutting by the drill-out bit, which may lead to increased damage of the drill-out bit. All of this may result in lower ROP as the drill-out bit becomes less effective or needs to be replaced prior to continuing with drilling.

Figure 2B:
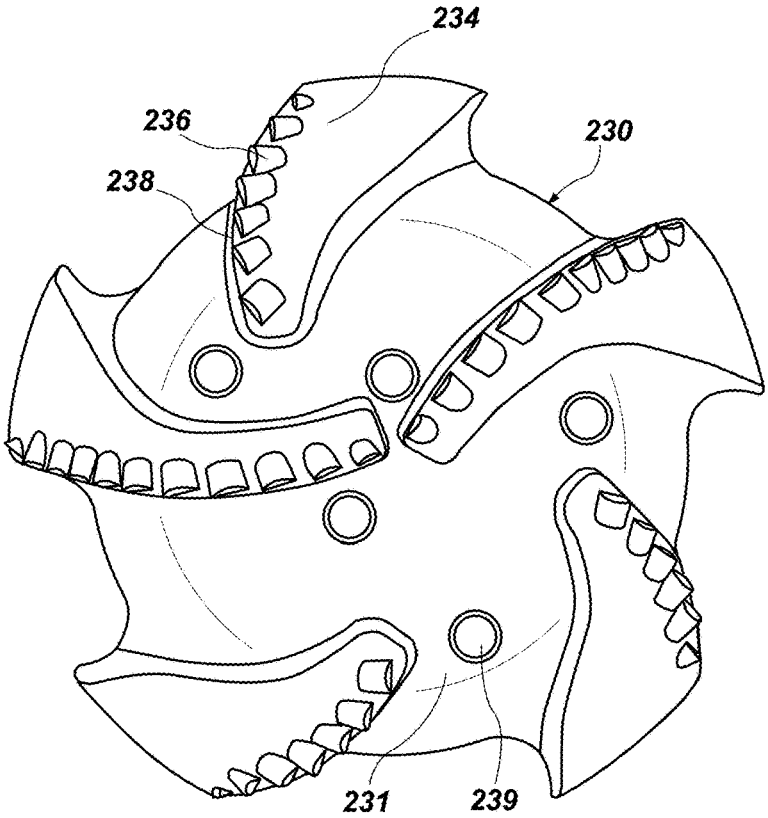
FIG. 2B illustrates an exemplary casing drill bit according to one example of the present disclosure.

The casing drill bit 230 shown in FIG. 2B may reduce chatter during a drill-out process, thereby reducing damage to a drill-out bit and increasing a ROP. In this example, the casing drill bit 230 may comprise a casing drill bit body 231. A plurality of blades 234 may extend from a bottom of the casing drill bit body 231. In this example, there are five blades 234 extending from the bottom of the casing drill bit body 231. However, this is just one nonlimiting example and the casing drill bit 230 may comprise any other number of blades 234. Each of the blades 234 may comprise a plurality of cutting elements 236.

The cutting blades 234 may comprise a profile 238 defining a swept or spiral shaped profile. In this example, the profiles 238 of the cutting blades 234 may be different from one another. This may aid in reducing chatter caused by interruptions during cutting during the drill-out process. FIG. 3 illustrates the variance in the profiles 238 of the cutting blades 234 of a casing drill bit 230. As shown in FIG. 3, the profiles of blades, such as blades 234 in FIG. 2B, may be formed such that the pitch between the blades varies. This results in different angular distances between cutting elements (e.g., cutting elements 236 in FIG. 2B) at different radial distances from the rotational axis on adjacent blades 234.

For example, as shown in FIG. 3, a first blade 234*a* may comprise a first cutting element 236*a* at a first radius r3 from a rotational axis of the drill bit. The first blade 234*a* may also comprise a second cutting element 236*b* at a second radius r5 from the rotational axis of the drill bit, wherein the second radius r5 is larger than the first radius r3. A second blade 234*b* which is adjacent to the first blade 234*a* (e.g., which circumferentially neighbors the first blade 234*a*) may similarly comprise a first cutting element 236*c* at the first radius r3 and a second cutting element 236*d* at the second radius r5. With the blades 234*a*, 234*b* being swept or spiraled with different profiles, an angular distance $\theta_{1c}$ between the first cutting element 236*a* of the first blade 234*a* and the first cutting element 236*c* of the second blade 234*b* is different than an angular distance $\theta_{1a}$ between the second cutting element 236*b* of the first blade 234*a* and the second cutting element 236*d* of the second blade 234*b*.

FIG. 4 graphically illustrates the varying angular distances between cutting elements at different radial distances from a central axis of the casing drill bit 230. In FIG. 4, profiles of the blades, such as blades 234*a* and 234*b* shown in FIG. 3 are represented based on a radial distance from the central axis and an angular distance around the drill bit. At a distance r1 from the central axis the blades are shown to be at angular distances of $\theta_{1e}$, $\theta_{2e}$, $\theta_{3e}$, $\theta_{4e}$, $\theta_{5e}$, and $\theta_{6e}$, respectively (wherein $\theta_{6e}$ is the angular distance between Blade 1 and Blade 6). Due to the differing swept profiles of the blades, none of the angular distances $\theta_{1e}$, $\theta_{2e}$, $\theta_{3e}$, $\theta_{4e}$, $\theta_{5e}$, and $\theta_{6e}$ between the blades at distance r1 are equal to one another.

Similarly, at a distance r2 from the central axis of the drill bit, Blades 1-6 are at angular distances $\theta_{1d}$, $\theta_{2d}$, $\theta_{3d}$, $\theta_{4d}$, $\theta_{5d}$, and $\theta_{6d}$, respectively, from one another. Due to the differing profiles of Blades 1-6, none of the angular distances $\theta_{1d}$, $\theta_{2d}$, $\theta_{3d}$, $\theta_{4d}$, $\theta_{5d}$, and $\theta_{6d}$ are equal. at a distance r3 from the central axis of the drill bit, Blades 1-6 are at angular distances $\theta_{1c}$, $\theta_{2c}$, $\theta_{3c}$, $\theta_{4c}$, $\theta_{5c}$, and $\theta_{6c}$, respectively, from one another. Due to the differing profiles of Blades 1-6, none of the angular distances $\theta_{1c}$, $\theta_{2c}$, $\theta_{3c}$, $\theta_{4c}$, $\theta_{5c}$, and $\theta_{6c}$ are equal. At a distance r4 from the central axis of the drill bit, Blades 1-6 are at angular distances $\theta_{1b}$, $\theta_{2b}$, $\theta_{3b}$, $\theta_{4b}$, $\theta_{5b}$, and $\theta_{6b}$, respectively, from one another. Due to the differing profiles of Blades 1-6, none of the angular distances $\theta_{1b}$, $\theta_{2b}$, $\theta_{3b}$, $\theta_{4b}$, $\theta_{5b}$, and $\theta_{6b}$ are equal. At a distance r5 from the central axis of the drill bit, Blades 1-6 are at angular distances $\theta_{1a}$, $\theta_{2a}$, $\theta_{3a}$, $\theta_{4a}$, $\theta_{5a}$, and $\theta_{6a}$, respectively, from one another. Due to the differing profiles of Blades 1-6, none of the angular distances $\theta_{1a}$, $\theta_{2a}$, $\theta_{3a}$, $\theta_{4a}$, $\theta_{5a}$, and $\theta_{6a}$ are equal. Furthermore, in some embodiments, none of the angular distances between the blades at any of the distances r1, r2, r3, r4, r5 are equal.

Returning to FIG. 2B, with the profiles 238 of the blades 234 being swept differently from one another resulting in the different angular distances between cutting elements at different radial distances from the rotational axis, a drill-out bit drilling through the casing drill bit 230 may encounter different cutting elements 236 of the various blades 234 at different times during the rotation of the drill-out bit instead of encountering cutting elements of each blade more or less simultaneously. Due to a more steady and consistent interaction with the cutting elements 236, there are less interruptions during the drill-out process as compared with a drill-out process of the baseline casing drill bit 210, resulting in decreased chatter and decreased damage to the drill-out bit.

The casing drill bit 230 may comprise some of the spiral shaped blades 234 extending to the center of the casing drill bit body 231. Other blades 234 may only partially extend from an outside of the casing drill bit body 231 towards the center of the casing drill bit body 231. This may aid in minimizing the cone size of the casing drill bit 230 and aid in removal of the material of the casing drill bit 230, such as steel.

The casing drill bit 230 may further comprise a plurality of fluid passageways 239. The fluid passageways 239 may be disposed on the bottom of the casing drill bit body 231 in a nonsymmetrical pattern. In this manner, as a drill-out bit drills through the casing drill bit 230, blades of the drill-out bit encounter different fluid channels at different times. Therefore, chatter may be further reduced and damage to the drill out bit may be further minimized.

Figure 5A:
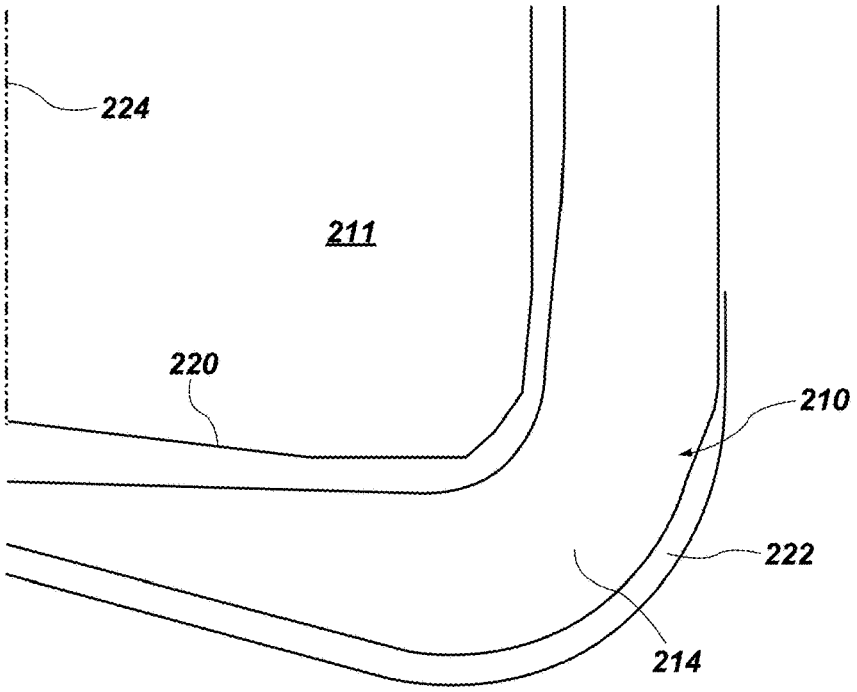
FIG. 5A illustrates a section profile diagram of a baseline casing drill bit.
Figure 5B:
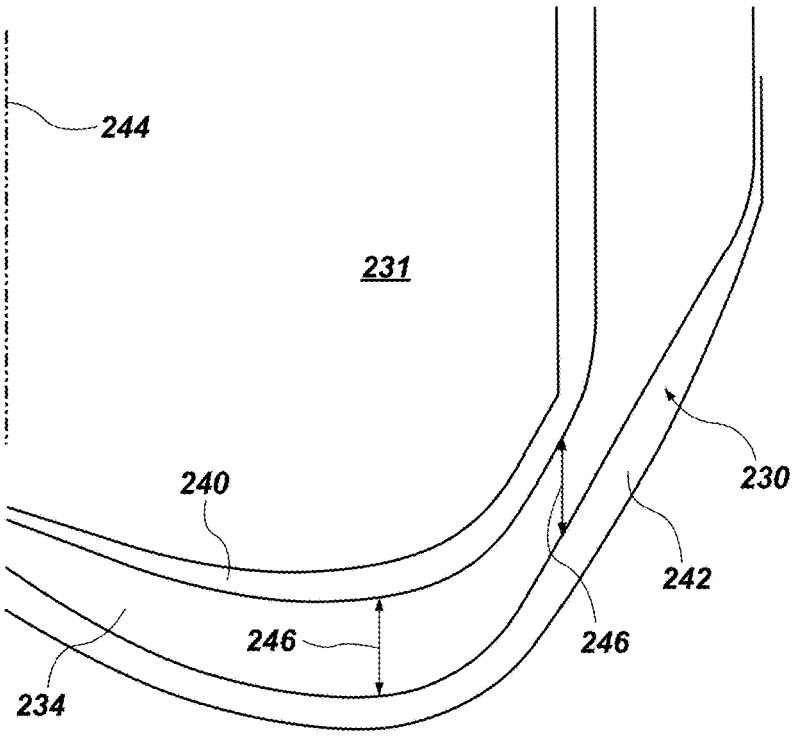
FIG. 5B illustrates a section profile diagram of an exemplary casing drill bit according to the present disclosure.

The casing drill bit 230 may be further modified as compared to a baseline casing drill bit 210 via a profile of the casing drill bit body 231. FIG. 5A shows a section profile diagram of the baseline casing drill bit 210, while FIG. 5B shows a section profile diagram of the casing drill bit 230. The baseline casing drill bit 210 may comprise a casing drill bit body 211 that has a profile 220 as shown in FIG. 5A. The profile 220 of the casing drill bit body 211 may extend perpendicular or almost perpendicular to a central axis 224, and then curve to be vertically to be parallel with the central axis 224. The blades 214 may extend from the bottom of the casing drill bit body 211. The blades 214 may have a profile 222 as shown in FIG. 5A.

When a drill-out bit drills through the baseline casing drill bit 210, blades of the drill-out bit may pass through the relatively flat bottom of the casing drill bit body 211 beginning at a single radius from the central axis 224 and then through progressively larger areas of the bottom of the casing drill bit body 211. Because of this, the portion of the blade of the drill-out bit that first punctures through the casing drill bit body 211 may begin to interact with the blades 214 of the baseline casing drill bit 210. Meanwhile, a remaining portion of blades the drill-out bit may still be cutting through the casing drill bit body 211. Because a portion of the blades of the drill-out bit are interfacing with the blades 214 of the baseline casing drill bit 210 while remaining portions of the blades of the drill-out bit are interfacing with the casing drill bit body 211, the drill-out bit may experience cutting interruptions resulting in increased chatter and damage to the drill-out bit.

The casing drill bit 230 according to this example of the disclosure may comprise a casing drill bit body 231 having a profile 240. As shown in FIG. 5B, a profile 240 of the bottom of the casing drill bit body 231 may be a curved profile. More specifically, the profile 240 of the bottom of the casing drill bit body 231 may be formed to match or at least partially match a profile of the blades of a drill-out bit (such as drill-out bit 120 shown in FIG. 1). Thus, the profile 240 of the casing drill bit body 231 shown in FIG. 5B is exemplary, and the profile 240 could be changed to match a blade profile of any desired drill-out bit.

With the profile 240 of the casing drill bit body 231 formed to match or at least partially match that of blades of the drill-out bit, the drill-out bit may extend through the profile 240 of the bottom of the casing drill bit body 231 almost all at once, thus allowing the blades of the drill-out bit to more seamlessly transition from drilling through the casing drill bit body 231 to drilling through the blades 234 of the casing drill bit 230. This may further reduce interruptions experienced by the drill-out bit during a drill-out process, thereby preventing chatter and damage to the drill-out bit. In some examples, the profile 240 of the casing drill bit body 231 may match at least 20% of a profile of the drill-out bit. In some examples, the profile 240 of the casing drill bit body 231 may match between 20% and 100% of the profile of the drill-out bit.

The blades 234 of the casing drill bit 230 may comprise a profile 242 such that a height of the blade (indicated by arrows 246) may be constant along at least a portion of the blades 234. This constant height along at least a portion of the blade 234 can further aid to reduce interruptions during cutting by the drill-out bit during a drilling out process by allowing blades of the drill-out bit to progress through cutting the blades 234 of the casing drill bit 230 in a more uniform manner. Furthermore, a height of the blade 234 can be minimized as compared to the baseline casing drill bit 210 to minimize an amount of material, such as steel, in the direction of the central axis 244. By reducing the amount of material to be removed in the axial direction, such as steel, damage to the drill-out bit may be further reduced.

In some instances, damage to the drill out bit may be sustained due to a portion of the casing drill bit being trapped underneath the drill-out bit during drill-out operations. This can occur when the drill-out bit first cuts through the casing drill bit at a non-zero radius relative to a central axis of the casing drill bit. When the drill-out bit cuts through the casing drill bit at the non-zero radius, a central portion of the casing drill bit may become difficult to retrieve out from underneath the drill-out bit. This may result in damage to the drill-out bit and may decrease ROP of drilling operations.

Accordingly, the profile 240 of the casing drill bit 230 and the profile 242 of the blades 234 of the casing drill bit 230 may be configured to ensure that the drill-out bit initially cuts all the way through the casing drill bit 230 at a center of the casing drill bit 230. That is, the drill-out bit initially cuts through the casing drill bit 230 at central axis 244. The profiles 240, 242 of the casing drill bit 230 can further be configured such that the drill-out bit cuts all the way through the casing drill bit 230 beginning from the central axis 244 and then progressively outwards from the central axis 244.

This may help ensure that no portion of the casing drill bit 230 becomes trapped underneath the drill-out bit.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. An earth boring system comprising:

a drill-out bit disposed at a distal end of a drill string, the drill-out bit comprising blades; and a casing drill bit comprising a drill bit body having a bottom profile and a plurality of casing drill bit blades, the bottom profile at least partially matching a profile of the blades of the drill-out bit, angular distances between circumferentially neighboring blades of the plurality of casing drill bit blades at a radial distance from a central axis of the casing drill bit all being unequal to one another, each of the blades having a different swept profile from one another, and the drill-out bit being operable to drill through the casing drill bit.

2. The earth boring system of claim 1, wherein the casing drill bit blades have a height that is constant along at least a portion of the casing drill bit blades.

3. The earth boring system of claim 2, wherein the casing drill bit blades comprise a spiral or swept profile.

4. The earth boring system of claim 1, wherein the casing drill bit further comprises fluid passageways extending through the bottom of the casing drill bit body, the fluid passageways being disposed nonsymmetrically about the bottom of the casing drill bit body.

5. The earth boring system of claim 1, wherein the bottom profile of the casing drill bit matches between 20% and 80% of the profile of the blades of the drill-out bit.

6. The earth boring system of claim 1, wherein the bottom profile of the casing drill bit is configured such that the blades of the drill-out bit initially drill completely through the casing drill bit at a rotational axis of the casing drill bit.

7. A casing drill bit comprising:

a casing drill bit body; and blades extending from the casing drill bit body, each blade comprising cutting elements, first angular distances between the cutting elements on circumferentially neighboring blades of the blades all being unequal to one another at a first radial distance from a rotational axis of the casing drill bit, and each of the blades having a different swept profile from one another.

8. The casing drill bit of claim 7, wherein the blades comprise a spiral or swept profile.

9. The casing drill bit of claim 7, wherein the casing drill bit body comprises a bottom having a bottom profile, the bottom profile matching a profile of drill-out blades of a drill-out bit operable to drill through the casing drill bit.

10. The casing drill bit of claim 9, wherein the blades of the casing drill bit comprise a height that is constant along at least a portion of the blades of the casing drill bit.

11. The casing drill bit of claim 7, further comprising fluid passageways extending through a bottom of the casing drill bit body, the fluid passageways being disposed nonsymmetrically about the bottom of the casing drill bit body.

12. The casing drill bit of claim 7, wherein second angular distances between the cutting elements on the circumferentially neighboring blades are unequal to one another at a second radial distance from the rotational axis of the casing drill bit.

13. The casing drill bit of claim 12, wherein the first angular distances are unequal to the second angular distances.

14. An earth boring system comprising:

a drill-out bit disposed at a distal end of a drill string, the drill-out bit comprising drill-out blades; and a casing drill bit comprising casing drill bit blades, wherein first angular distances between neighboring casing drill bit blades of the casing drill bit blades at a first radius are not equal to second angular distances between the neighboring casing drill bit blades at a second radius, the second radius being larger than the first radius, each of the blades having a different swept profile from one another, and the drill-out bit being configured to drill through the casing drill bit.

15. The earth boring system of claim 14 wherein the casing drill bit comprises a drill bit body having a bottom profile matching a profile of drill-out blades of the drill-out bit.

16. The earth boring system of claim 15, wherein the casing drill bit blades extend from a bottom of the casing drill bit body, the casing drill bit blades having a height that is constant along at least a portion of the casing drill bit blades.

17. The earth boring system of claim 14, wherein the casing drill bit blades comprise a spiral or swept profile.

18. The earth boring system of claim 14, wherein the casing drill bit further comprises fluid passageways extending through a bottom of the casing drill bit, the fluid passageways being disposed nonsymmetrically about the bottom of the casing drill bit.

* * * * *